United States Patent [19]

Giles

[11] Patent Number: 5,041,001

[45] Date of Patent: Aug. 20, 1991

[54] WATT-HOUR METER PLUG

[75] Inventor: Jonathan P. Giles, Columbia, S.C.

[73] Assignee: Innovative Building Products, S.C.

[21] Appl. No.: 618,225

[22] Filed: Nov. 26, 1990

[51] Int. Cl.[5] ..... H01R 29/00

[52] U.S. Cl. ..... 439/189; 361/372; 361/375; 439/694

[58] Field of Search ..... 439/106, 189, 455, 682, 439/692-694; 361/372-375

[56] References Cited

U.S. PATENT DOCUMENTS

| | | | |
|---|---|---|---|
| 1,817,004 | 8/1931 | Hubbell, Jr. | 439/694 |
| 2,383,109 | 8/1945 | Conlan | 173/334 |
| 2,606,232 | 8/1952 | St. John | 439/189 |
| 2,748,359 | 5/1956 | Swan | 339/28 |
| 2,805,403 | 9/1957 | Road | 339/31 |
| 3,136,925 | 6/1964 | Klein | 361/375 |
| 3,202,977 | 8/1965 | Sims | 361/372 |
| 3,362,006 | 1/1968 | Fuller | 339/14 |
| 3,643,209 | 2/1972 | Caston | 361/372 |

*Primary Examiner*—Paula A. Bradley
*Attorney, Agent, or Firm*—F. Rhett Brockington

[57] ABSTRACT

An electrical device for electrifying a building equipped with an in electrical connection with a watt-hour meter box, where the box has a socket that is designed to receive a watt-hour meter and covering glass case, wherein the device is a watt-hour meter plug comprised of an electrically insulative structural plate having an outside and an inside, where the outside is the side normally visible when the watt-hour meter plug is inserted in the meter box, where the inside of the plate is fitted with at least two terminal blades, each of which projects perpendicularly from the plate, wherein the terminal blades are positioned such that when the plate is pressed into the socket a single electrifiable terminal blade inserts into a matching single terminal clamp within the watt-hour meter box, wherein each single electrifiable terminal blade, that is to carry electricity, is in electrical connection with a wire that is an electrical lead.

4 Claims, 1 Drawing Sheet

WATT-HOUR METER PLUG

BACKGROUND OF THE INVENTION

The invention relates generally to electrical connectors, and more particularly to electrical connectors for temporarily connecting power from a utility pole to a building.

A temporary electrical connection to a house or other building, having at least rudimentary wiring such as a house under construction not yet tied into a power line, is usually required prior to the installation of the permanent power line in order to finish the work on the inside. Typically, one of the first steps in the wiring process of new construction is to mount a meter box, which will ultimately house a watt-hour meter, where the meter box is wired to the interior. On the inside, electrical connecting equipment, such as panels of relays, breaker boxes, wall sockets and so forth, all feed off the wiring leading from the meter box. A method for effecting a temporary connection is to run a power line from a breaker box on a saw pole to the watt-hour meter box mounted on the building under construction. A saw pole is a conventional term used to designate a utility pole erected for the principal purpose of connecting an electric saw, and is typically the initial electrical power source to the property.

The meter box contains terminal clamps designed to receive the terminal blades which project from the back of a watt-hour meter. The electrical leads of a power line, stripped of insulation therein exposing the conductive wire, are approximately the right thickness so as to be inserted into the terminal clamps, and an expeditious electrical connection can be made from the saw pole to the interior of the building under construction, by inserting the exposed wires into the terminal clamps. While effective, this type of connection can easily be dislodged, and is a potential source of electrical shock to the public and to the individual making the connection. Additionally, it is very easy to get the wires crossed, therein accidentally mis-wiring the connection, which could cause significant property damage to the associated circuitry and connected equipment. An electric plug uniquely designed for connecting power into the meter-box substantially eliminates these hazards.

Related art is scarce. Road U.S. Pat. No. 2,805,405 describes the terminal construction for meters. Electrical connectors have been described by Swan U.S. Pat. No. 2,748,359, Conlan U.S. Pat. No. 2,383,107 and Fuller U.S. Pat. No. 3,362,006.

SUMMARY OF THE INVENTION

The invention is an apparatus that enables a person unskilled in the art of electrical wiring to safely and easily connect electrical power from a temporary service pole, commonly referred to as a saw pole, to a building or similar structure fitted with a watt-hour meter box. More specifically the invention is an apparatus that is a uniquely designed electrical plug which can plug into the circular socket of a watt-hour meter box nominally equipped with a meter and covering glass case. Conventionally, the circular socket of a watt-hour meter box contains four or more terminal clamps located approximately in a rectangular configuration. The terminal clamps enable a watt-hour meter to be connected to the meter box in order to monitor the consumption of electricity, which in the permanent configuration, the meter box is hard wired to the power line.

The terminal clamps, in addition to serving as an electrical connection, also serve to physically mount the watt-hour meter in the meter box, wherein the meter has an opposing set of terminal blades that project from the rear of a plate housing the meter, into the terminal clamps. The applicant has found that these same terminal clamps within the meter box can be used to not only connect a watt-hour meter, but also, alternatively, to serve as a means of establishing temporary electrical power, such as electricity from a saw pole, to the building served by the meter box. The instant invention is a uniquely designed plug, having terminal blades arranged like those of a watt-hour meter, where the terminal blades are of sufficient dimension and conductivity as to adequately carry a household current load, where the plug enables a building that either has not been wired with a permanent power line or for some other reason has incurred a power line outage, to be electrified by connection through the meter–meter box couplings. The plug is designed to quickly and safely establish electrical power to a building that has at least rudimentary electrical wiring, as would be the case for a building under construction. New construction is anticipated to be the largest application.

The meter plug is comprised of an electrically insulative plate in which are mounted terminal blades in an essentially rectangular configuration such that the position of the terminal blades is similar to the terminal blades projecting from the rear of a watt-hour meter. At least two of the terminal blades, which are isolated electrically from each other, are connected to an electrical lead of the power line. When the watt-hour meter plug is installed, a third lead, a shielded ground wire that accompanies the two electrified leads, is connected directly to a ground terminal pole housed in the watt-hour meter box. The meter plug is equipped with a strain relief clamp that clamps down on the power line, therein securing the power line firmly to the plug. The clamp prevents the electrical leads within the power line from being accidentally disconnected from the terminals of the watt-hour meter plug. The instant invention is connected to the meter box by first connecting the shielded ground wire to the ground terminal of the meter box, and then plugging the meter plug into the circular socket of the watt-hour meter box. Preferably the power line connected to the plug is not electrified until after the meter plug is installed.

DETAILED DESCRIPTION OF THE PREFERRED EMBODIMENT

Figure 1:
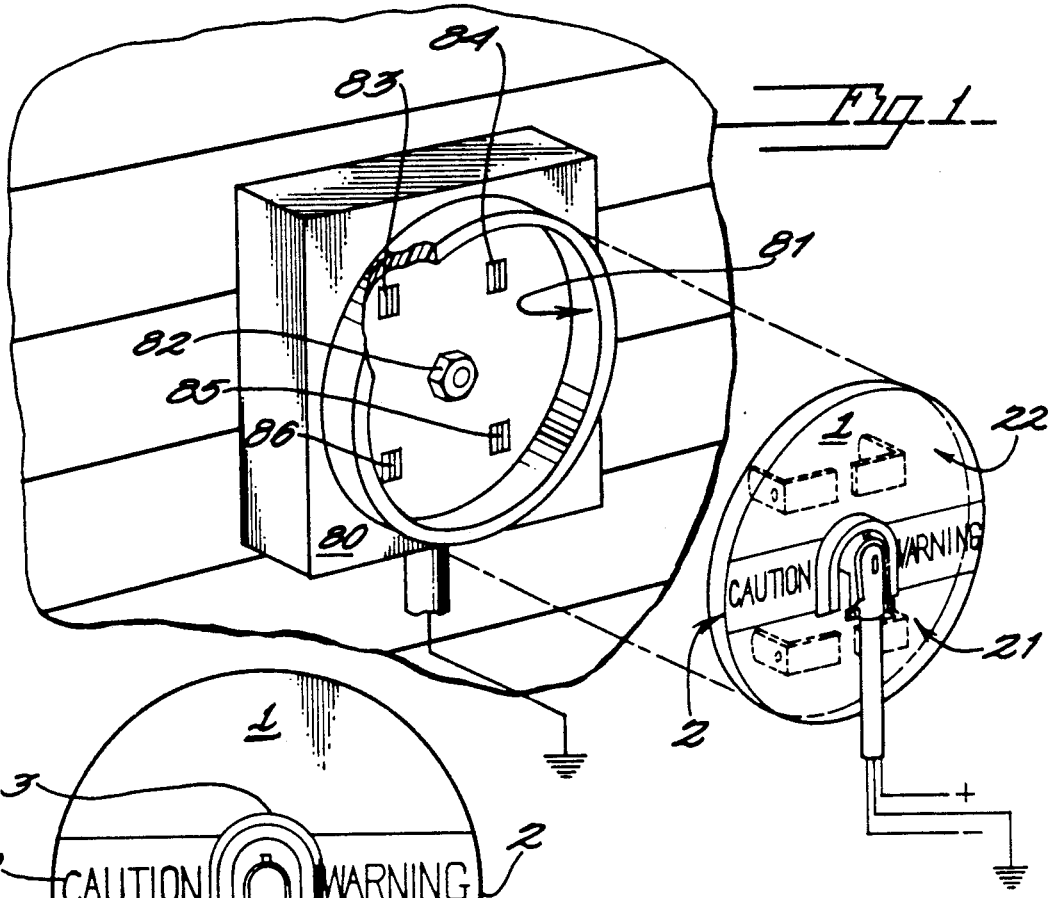
FIG. 1 is a partially cut-away exploded view illustrating a watt-hour meter plug operationally inserted into the circular socket of a meter box.
Figure 3:
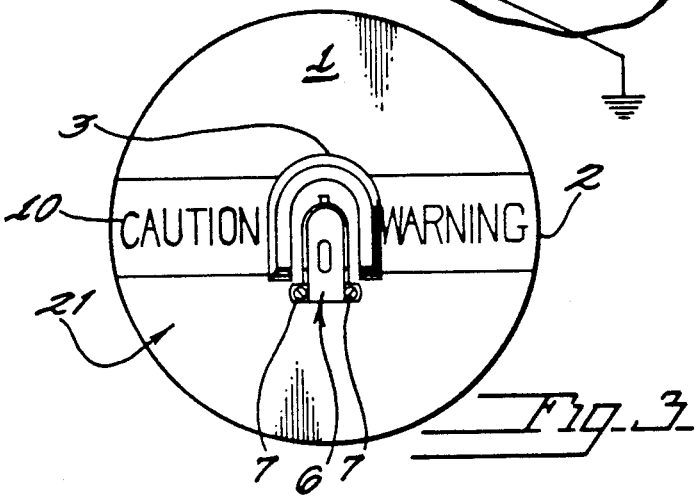
FIG. 3 is a perspective view of the preferred embodiment as seen from the outside.
Figure 4:
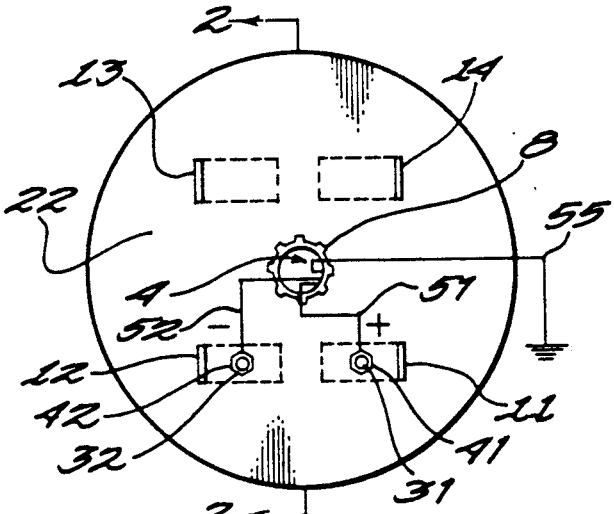
FIG. 4 is a perspective view of the preferred embodiment as seen from the inside.

The meter plug 1 as shown in FIG. 1 is plugged into the circular socket 81 of a watt-hour meter box 80 which has four terminal clamps 83, 84, 85, and 86, and a ground terminal 82. The plug 1 is comprised of a plate 2 having an outside 21 and an inside 22, where the outside 21 would be the side normally visible when the plug 1 is inserted in the meter box. The outside 21, which is shown in FIG. 3, has a hood 3 which is integral to the plate 2, where the hood 3 sheds a hole 4 that communicates through the plate 2 from the outside 21 to the inside 22. The inside 22 is shown in FIG. 4, and the hole 4 is visible in this figure. The hole 4 is fitted with an L shaped strain relief clamp 6 having two screws 7 which tighten the clamp down on the power line 5. FIG. 3 illustrates the use of the L shaped strain relief clamp 6. The hood 3 deflects precipitation away from the hole 4, and protects the clamp. The L shaped strain relief clamp 6 is affixed to the plate 2 on the inside via a nut 8 which is tightened down on threaded conduit section 9 of the clamp 6 which projects through the hole 4. The diameter of the plate is comparable to the diameter of the circular socket 81 of the meter box 80 which is the receptacle for the plug 1. Typically, this is approximately 6.75 inches (17.15 centimeters). The plate 2 is formed of an electrically insulative material. ABS (acrylonitrile-butadiene-styrene) is suitable, and it can be injection molded. The outside 21 is labeled with a cautionary decal 10.

Figure 2:
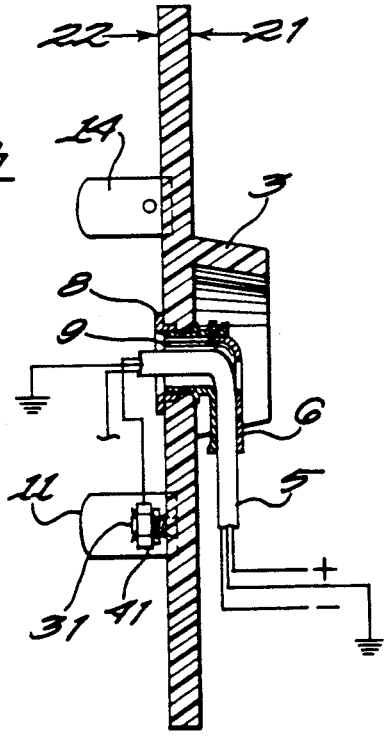
FIG. 2 is a sectional planar view of the meter plug taken along the plane defined by the sectional line 2—2 of FIG. 4. The power line with three electrical leads has been incorporated into the drawing.

The inside 22 of the plate 2 as shown in FIG. 4 has 4 terminal blades 11, 12, 13 and 14, which are embedded in the body of the plate. FIG. 2 illustrates the position of the terminal blades within the plate. The terminal blades, which are positioned such that they are roughly at corners of a 3×3.5 inch (7.62×8.89 centimeters) rectangle are electrically insulated from each other. The position of the terminal blades 11, 12, 13 and 14 is such that they are aligned with the corresponding terminal clamp located in the circular socket of the meter box, as shown in FIG. 1. The terminal blades 11 and 12 are electrified as they are connected to terminal poles 31 and 32. Terminal poles 31 and 32 project above the plate ⅜ inches (0.95 centimeters). The terminal poles 31 and 32 are threaded and fitted with 5/16 inch (0.79 centimeter) nuts 41 and 42. In the case of two phase electrical current, which is standard for most residences, terminal blades 12 and 13 are not electrified, serving principally to add to the support of the meter plug 1. The terminal blades 11, 12, 13 and 14 project perpendicularly from the surface of the plate. They are are approximately 1.25 inch (3.175 centimeters) long, and 1/16 inch (0.159 centimeters) thick and 11/16 inch (1.746 centimeters) high.

The power line 5 communicates to the inside through hole 4, after which it breaks up into three electrically conductive wires, two of which at a given instant in the alternating current cycle, can be identified as positive and negative, while the third is always ground. In FIG. 4 wire 51 is connected to terminal pole 31, wire 52 is connected to terminal pole 32, and ground wire 55 is connected to a ground terminal 82 located within the circular socket 81 of the meter box 80.

I claim:

1. An electrical device for electrifying a building and other structures which are equipped with and in electrical connection with a watt-hour meter box, where said box has a socket that is designed to receive a watt-hour meter and covering glass case, wherein said device is a watt-hour meter plug comprised of:

an electrically insulative structural plate having an outside and an inside, where the outside is the side normally visible when the watt-hour meter plug is inserted in the meter box, where the inside of the plate is fitted with at least four terminal blades, each of which projects perpendicularly from the plate, wherein said terminal blades are positioned such that when the plate is pressed into the socket a single electrifiable terminal blade inserts into a matching single terminal clamp within the watt-hour meter box, wherein each single electrifiable terminal blade, that is to carry electricity, is in electrical connection with a wire that is an electrical lead, wherein the four terminal blades are arranged on, in an approximately rectangular configuration, and imbedded in the inside of the plate, wherein two of the terminal blades are single electrifiable terminal blades each having an adjoining terminal pole to which is attached the electrical lead, and the other two are single non-electrifiable terminal blades that serve principally as support for the plug.

2. The watt-hour meter plug as claimed in claim 1, wherein the plate has a communicating hole that passes from the outside of the plate to the inside, wherein said hole is fitted with an L shaped strain-relief clamp mounted on the outside and secured on the inside with a nut, wherein through said L shaped strain relief clamp is connected to a power line housing the electrical leads.

3. The watt-hour meter plug as claimed in claim 2, wherein the plate is formed so as to have a raised ridge of material hooded over the hole which sheds said communicating hole from precipitation and otherwise protects the L shaped strain relief clamp.

4. The watt-hour meter plug as claimed in claim 3, wherein said plate has precautionary warning labels.

* * * * *